United States Patent [19]

Schoneberger et al.

[11] 4,193,345

[45] Mar. 18, 1980

[54] DEVICE FOR ADJUSTMENT OF THE INK FLOW ON PRINTING PRESS INKING UNITS

[75] Inventors: Edgar F. Schoneberger, Selingestadt; Alfred Dorn, Lammerspiel, both of Fed. Rep. of Germany

[73] Assignee: Roland Offsetmaschinenfabrik Faber & Schleicher AG, Fed. Rep. of Germany

[21] Appl. No.: 932,717

[22] Filed: Aug. 11, 1978

Related U.S. Application Data

[63] Continuation-in-part of Ser. No. 890,934, Mar. 28, 1978, abandoned.

[30] Foreign Application Priority Data

Apr. 1, 1977 [DE] Fed. Rep. of Germany ..... 2714577

[51] Int. Cl.[2] ..... B41F 31/04

[52] U.S. Cl. ..... 101/365; 101/DIG. 26

[58] Field of Search ..... 101/365, DIG. 26, 350, 101/363, 148; 340/163, 147 R, 147 B; 318/696, 625, 663; 251/131, 133, 134; 137/554; 118/261

[56] References Cited

U.S. PATENT DOCUMENTS

| | | | |
|---|---|---|---|
| 3,057,294 | 10/1962 | Jameson | 101/365 |
| 3,702,587 | 11/1972 | Lee | 101/365 |
| 3,774,536 | 11/1973 | Raymond et al. | 101/207 |
| 3,792,659 | 2/1974 | Albrecht | 101/365 |
| 3,930,447 | 1/1976 | Murray | 101/365 |

*Primary Examiner*—J. Reed Fisher

*Attorney, Agent, or Firm*—Leydig, Voit, Osann, Mayer & Holt, Ltd.

[57] ABSTRACT

An ink metering system for a printing press for metering ink to individual column positions on a printing plate in which the fountain blade is formed in individual sections having power actuators to establish film-forming gaps at corresponding positions. Linear follow-up potentiometers are provided having their slides respectively coupled to the blade sections so that when the potentiometers are connected to a source of reference voltage, and the sections initially adjusted, the slider voltage provides a direct indication of the width of the gap. To change the setting over the entire width of the blade, a variable voltage supply is provided with a control for shifting the voltage from reference level to a calibrated level of offset voltage, on one side or the other of the reference, to bring about a percentage change in voltage at each of the adjustable blade sections. To create a voltage differential for follow-up purposes, each actuator has a voltage storage, or "memory", device together with a voltage "comparator" to produce an output dependent upon the algebraic sum of the "new" and "old" voltages. Such output energizes the actuator to move each blade section and potentiometer slider to a new position in which all of the gaps are changed in the same direction and as a fixed percentage of their initial settings.

16 Claims, 10 Drawing Figures

FIRST BLADE SECTION

APPLIED VOLTAGE CHANGED BY A FACTOR OF 10/1.5

SECOND BLADE SECTION

FIRST BLADE SECTION

APPLIED VOLTAGE CHANGED BY A FACTOR OF 10/0.5

SECOND BLADE SECTION

DEVICE FOR ADJUSTMENT OF THE INK FLOW ON PRINTING PRESS INKING UNITS

This is a continuation-in-part of application Ser. No. 890,934, now abandoned, filed Mar. 28, 1978.

Control of ink flow in a printing press depends upon several varying parameters, for example the temperature in the inking unit, the temperature of the printing plate, the viscosity of the ink, the degree of dampening and the like. The change of these parameters, for example, during running conditions, requires that the ink flow from the fountain roller be varied simultaneously over the entire width of the inking fountain.

In German patent specification No. 1,241,840 means are disclosed for adjusting metering elements simultaneously over the full width of the fountain blade but only in identical degree. It is also known, as shown in German patent specification No. 1,942,732, to adjust a ductor over the full width of a fountain roller thereby to meter the ink flow in the direction of the plate. Furthermore, it is known from German registered design No. 7,139,991 to meter ink flow from an undershot fountain to the printing plate by varying the contact time of the lifter roller. Simultaneous full-width adjustment of ink flow, exemplified by the above, has the disadvantage that change across the width takes place in absolute rather than relative units and thus any general increase or decrease in the flow tends to upset the ratio of the different amounts of ink being fed, according to relative need, in adjacent column positions. For example, when the feed at two column positions having an unlike ink requirement are increased the same amount, the effect is disproportionately great at the column position where the feed is initially small, thereby throwing the column-by-column feed adjustment out of balance.

It is, accordingly, an object of the present invention to provide an ink metering system for a printing press having a sectional fountain blade having differential gaps for passing different amount of inks at the various column positions but which includes provision for changing the flow at each column position in proportion to the existing gap. In other words, it is an object of the invention to provide an inking system in which the ink being fed in a different column position may be simultaneously adjusted as an increase or decrease in the percentage of ink being initially fed in the column position. In short, it is an object of the invention to provide means for changing the rate of ink flow across the entire inking unit but in which the change in flow in absolute units varies from column to column and is such as to maintain the same relative flow in the column positions.

It is an object of the invention to provide a device of the above type in which ink flow in each of the column positions may be manually proportioned depending upon relative need and as an initial step and in which necessary general lightening or darkening may be brought about across the width of the printed sheet as a result of any changing condition, without affecting the relative amounts of ink fed on a column-by-column basis, that is to say, without changing the initial ink balance previously established by the press operator.

It is a general object of the present invention to provide an ink metering system capable of a percentage-wise column-by-column increase or decrease in ink density effective simultaneously over the width of the sheet but which is simple and highly reliable, which is easily and conveniently controlled, and which permits prompt calibrated changes in density across the width of the sheet without destroying the previous adjustment of relative feed rates. It is a more specific object to provide an ink metering system which requires a minimum of skill in arriving at the final adjustment, the process consisting of an initial relative adjustment of the blade sections without especial care as to final density, followed by simultaneous and largely automatic adjustment in density over the entire page width, to optimize the printed product, and particularly in the face of changing conditions, a procedure easily mastered by the pressman with only limited skill or experience.

Other objects and advantages of the invention will become apparent upon reading the attached detailed description and upon reference to the drawings in which:

FIG. 1 is a diagrammatic plan view showing a fountain roller used in a typical printing press having a metering blade consisting of a number of adjacent relatively slidable sections with means for individual adjustment of the gap at each section.

FIG. 1*a* is a diagram based upon FIG. 1 and showing the relative positions of the blade sections following a predetermined percentage increase, with the figures denoting units of gap.

FIG. 2 is a schematic diagram of a control system constructed in accordance with the present invention and capable of positioning the blade sections of FIG. 1.

FIG. 2*a* is a schematic diagram of a typical memory or storage device which may be employed in FIG. 2.

FIG. 2*b* is a schematic diagram of a typical type of voltage comparator which may be employed in FIG. 2.

While the invention has been described in connection with a preferred embodiment, it will be understood that we do not intend to be limited to the particular embodiment but intend, on the contrary, to cover the various alternative and equivalent constructions included within the spirit and scope of the appended claims.

Figure 1:
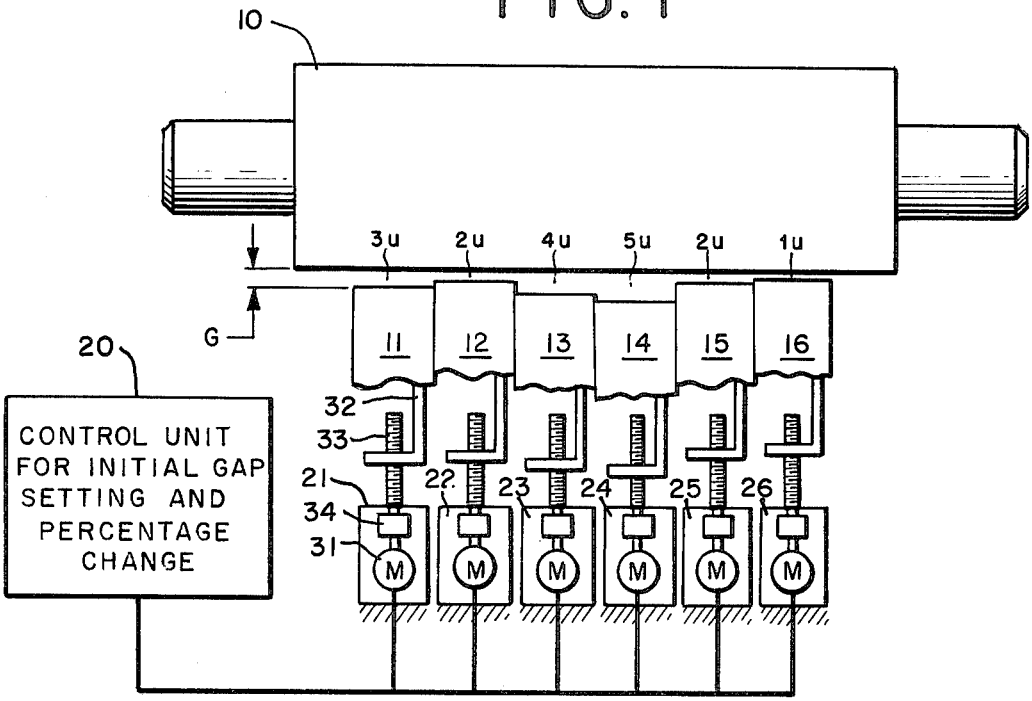
Figure 1A:
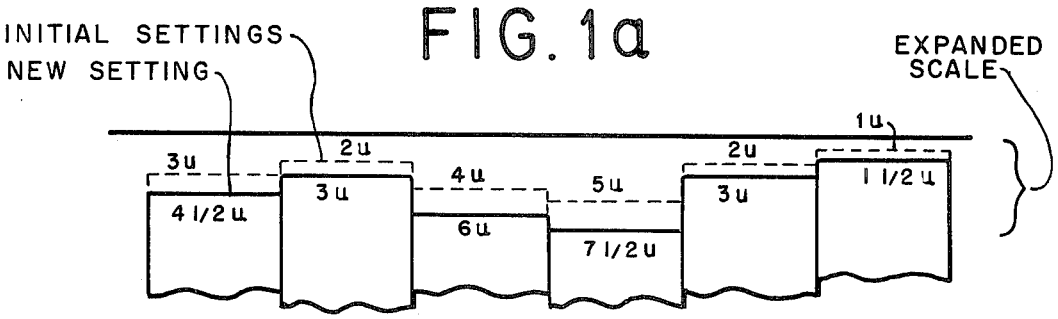

Turning now to the drawings there is shown in FIG. 1 the fountain roller 10 of a typical printing press, for example, a lithographic press, having a composite member for metering of ink film on a column-by-column basis, the metering means being in the form of a fountain blade having individual sections, here six in number, and indicated at 11–16. The number six has been taken only as representative of a typical installation, and while the term "column" has been used it will be understood that this term is for convenience only to denote a series of adjacent zones of film thickness.

In operation, each of the blade sections is manually adjusted to create an initial gap G between the fountain roller and the edge of the blade, which gap determines the thickness of ink film which is eventually applied at the corresponding column position, or zone, of the printing plate. Such zonal variations are necessary in order to accommodate the rate at which ink is actually consumed by the sheet in the various longitudinal areas. To serve as an example as the discussion proceeds, FIG. 1 shows the gaps G as initially adjusted to produce a predetermined pattern of ink flow with gaps of 3, 2, 4, 5, 2, and 1 units, respectively, the units being arbitrary in either the British or metric system and with the gaps being shown greatly exaggerated for the sake of clarity.

For the purpose of individual and collective adjustment of the blade sections 11–16 each blade section has its own blade setting assembly 21–26, respectively, under the control of a remote control unit 20 which, as will be seen, is capable of setting each blade section percentagewise from its condition of initial adjustment.

Figures 2, 2A, 2B:
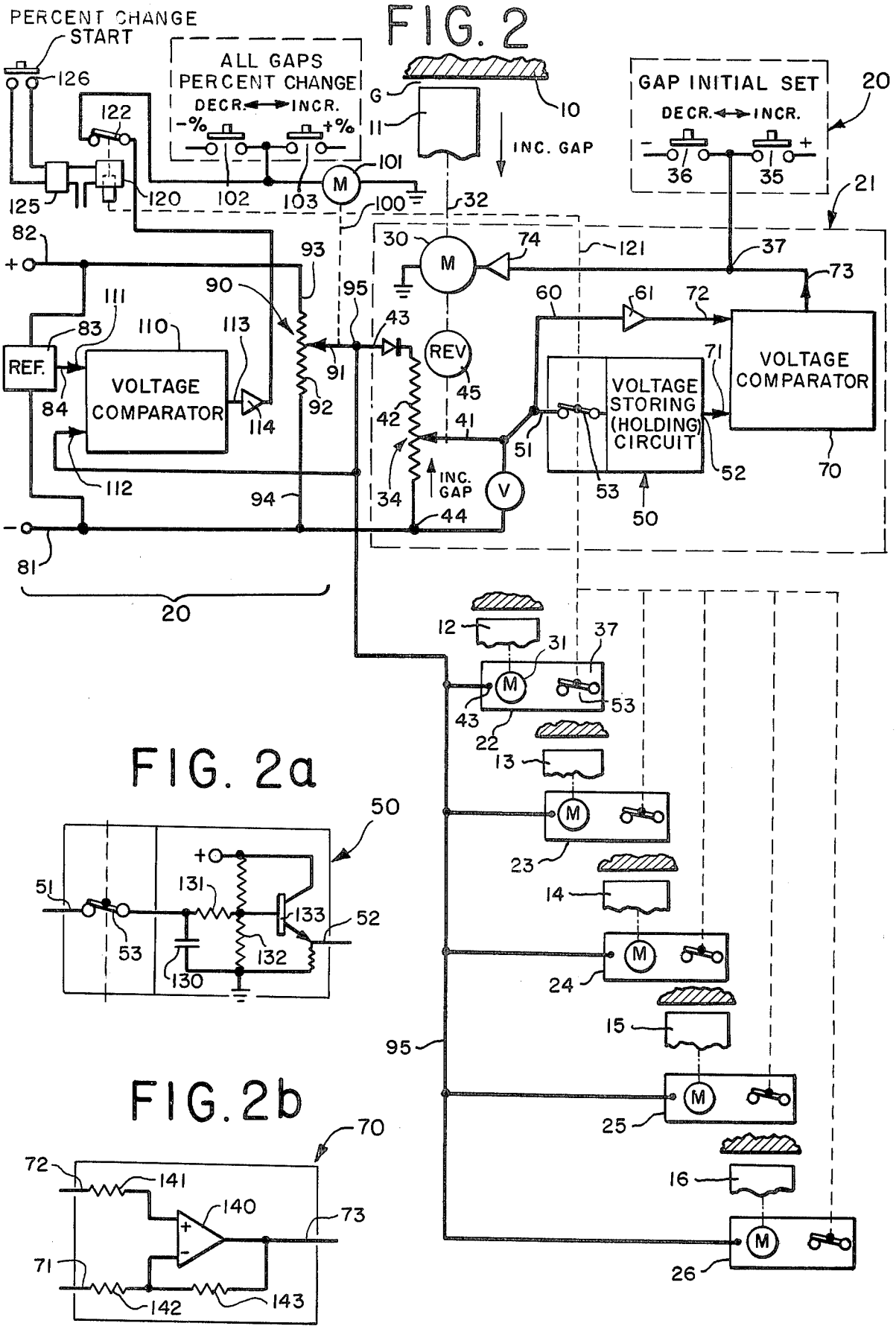

Taking the setting assembly 21, associated with blade section 11, as representative, and as shown in FIGS. 1 and 2, it includes a miniature reversible electric motor 31 which is coupled to the section 11 by means of a connecting link 32, for example, through a threaded drive connection 33. At the same time that the actuator 31 drives the blade section it also drives the slider of a follow-up potentiometer 34. When the follow-up potentiometer is supplied with reference voltage, as will appear, the slider output voltage serves as a direct measure of the gap. To initially adjust the gap, the reversible motor 31 is driven in one direction or the other by any desired means, for example, by "increase" and "decrease" pushbuttons 35, 36 connected to a terminal 37 and which are preferably included in the central control unit 20 for convenient remote control.

After the blade sections 11–16 have been set by the press operator to produce proper relative feeding of ink to the column positions, it will be often desired, usually as a result of a change in printing conditions, to increase or decrease the rate of ink feed across the printed page taken as a whole. Conventional means for bringing about an overall increase or overall decrease have been found to be disadvantageous since any "across the board" increase will be disproportionately great at blade sections having small gaps and will affect blade sections having large gaps hardly at all. We have found that it is desirable, in increasing or decreasing the feeding of ink across the page, to avoid equal increments at each blade section and, instead, to tailor the increment or decrement automatically to a percentage of the gap which already exists.

Accordingly, we provide in each of the setting assemblies a voltage memory device for each potentiometer for responding to, and storing, the value of the initial slider position voltage. Manual means are provided for adjusting the voltage supply so that the voltage furnished to all of the follow-up potentiometers is changed in the same direction and amount to bring about a change in the voltages on the various sliders to a new voltage related percentagewise to the initially existing voltage. A comparator responsive to the difference between each initially existing voltage, and new voltage, produces a set of differential voltages, the different voltages being applied to the respective actuating motors so that the associated sliders are moved to new equilibrium positions in which each differential voltage is reduced to zero by follow-up action so that all of the blade gaps simultaneously undergo a change to new gap widths which are related to the respective initial gap widths by the same fixed percentage, with means being provided, finally, for automatically restoring the voltage source to the reference level in readiness for a new cycle.

Turning to the schematic circuit diagram of FIG. 2, discussion may be focused first upon the follow-up potentiometer 34 and the means for supplying it with voltage. The follow-up potentiometer has a slider 41 slidable upon a resistance element 42 having an input terminal 43 and a base terminal 44. The potentiometer is preferably of the linear multi-turn type having a drive connection 45 which includes means for relative reversal so that, as viewed in FIG. 2, "downward" movement of the blade section 11 on the sheet corresponds to "upward" movement of the slider 41.

It will be assumed in the discussion which follows that a "reference" voltage is normally supplied to the input terminal 43, such reference voltage, simply by way of example, being taken at ten volts. If desired, a voltmeter V may be connected between the potentiometer terminals 41, 44, the voltmeter giving a reading directly in terms of gap as long as reference voltage is being applied.

For the purpose of responding to, and storing, the initial, or existing, slider position voltage, a voltage storing or holding circuit, also referred to as a memory device, 50 has an input terminal 51 directly connected to the slider and an output terminal 52, as well as switch 53 at the input to provide temporary isolation. The details of the voltage storing memory device are not essential to the invention, and a typical device suited for this purpose will be subsequently discussed in FIG. 2*a*. It will suffice for the present to say that as long as the isolating switch 53 is closed, the device will respond to the initial voltage existing at the input so that subsequently, when the isolating switch is opened, the stored initial voltage will appear at the output terminal 52, indicative of the pre-existing dimension of the gap.

In carrying out the invention manual means are provided for opening the isolation switches and for immediately thereafter changing the voltage which is applied to the followup potentiometer from the normal reference level to a value either above or below the reference level to change, percentagewise, the voltage which exists on the potentiometer slider to a "new" voltage, with the new voltage being compared to the pre-existing slider voltage to produce a differential voltage which is applied to the electric motor 31 to correctively drive the blade section to a new position, accompanied by follow-up action of the slider to a corresponding new position. For transmitting the "new" voltage, a connection 60 is made directly to the potentiometer slider and passes, preferably via an emitter-follower stage or the like 61, to a voltage comparator device 70, where the new and initial voltages are compared. The specific design of the voltage comparator device is not a part of the present invention and will be subsequently discussed, simply by way of example, in connection with FIG. 2*b*. It will suffice for the present to say that the device, indicated at 70, has input terminals 71, 72, responsive to the initial and new voltages, respectively, with the differential between them being fed to the output terminal 73 which is connected via suitable amplifier 74 to the actuator motor 31, driving the latter in accordance with the magnitude and direction of the differential.

Prior to discussing a typical sequence of operation it will be helpful to understand in greater detail the percentage change or control assembly which serves as the voltage supply for the potentiometers in all of the blade setting assemblies 21–26. The assembly 20 includes negative and positive input terminals 81, 82 which energize a master reference voltage source 83 having an output terminal at a reference voltage which may, as already mentioned, be ten volts. Connected across the input terminals is a supply potentiometer 90 having a slider 91 riding upon a resistance element 92 and having terminals 93, 94. With the slider 91 in its normal reference position, a reference voltage of the assumed ten volts appears at an output terminal 95 which is connected to the input terminals of all of the follow-up potentiometers in the various setting assemblies 21–26.

For the purpose of manually setting the supply voltage in one direction or the other from the reference value to bring about a percentage shift of all of the blade sections, the slider 91 of the supply potentiometer is coupled, via a mechanical connection 100, to a reversible drive motor 101 having "increase" and "decrease" pushbuttons 102, 103.

In carrying out the present invention means are provided for automatically restoring the supply to reference voltage after a percentage change has been completed. This is accomplished in the present instance by a comparator device 110 having input terminals 111, 112 and an output terminal 113. Such comparator device may employ the same circuitry as that discussed in connection with FIG. 2*b*. The input terminals 111, 112 are respectively connected to the master reference 84 and to the supply output terminal 95. The output terminal 113 of the comparator, with an auxiliary power amplifier 114 preferably interposed, is connected to energize the reversible motor 101 which positions the slider 91 of the supply. Thus if the supply output voltage should differ from the master reference, as it normally will following the making of a percentage blade adjustment, the differential voltage produced at the output terminal 113, which is of a magnitude and direction as to drive the motor 101 and slider 91 correctively in a direction to cause the output voltage of the supply to be restored to the master reference level, thereby reduces the differential to zero, turning off the motor 101.

In short, then, the setting assemblies are all provided normally with reference voltage, assumed to be ten volts, with the pushbuttons 102, 103 being available to change the supply voltage either upwardly or downwardly to bring about a shift in the follow-up potentiometers of the various setting assemblies, thereby to bring about a proportional change in all of the gaps, with provision for automatic reset of the supply voltage to the reference condition.

In accordance with one of the aspects of the present invention means are provided for simultaneously operating all of the isolation switches 53 in the voltage memory devices 50 and for temporarily disabling the reference-restoring feature of the supply. This is accomplished in the great instance by a relay 120 which is coupled, via a connection 121 to all of the isolating switches 53 and which has, in addition, an auxiliary disabling contact 122 of the normally closed type in series with the motor 101 of the voltage supply. This disables such motor against acting upon the slider 91 as long as a percentage change in blade position is taking place.

Still further in accordance with the invention the relay 20 is controlled by a timer of the type providing "delay on break" to permit time (a few seconds at most) for a percentage blade change to take place in all positions before the reference condition is again restored. The details of such timer do not form a part of the present invention and timers of the "delay on break" type, indicated at 125, and whose operation is initiated by the pressing of a pushbutton 126 are available as a catalog item.

It is one of the features of the present invention that to secure percentage increases in the gap all along the width of the fountain, all of the follow-up potentiometers which produce such proportioned increases must be subjected to a lower-than-reference voltage whereas the converse is also true. It is also one of the features of the invention that the change in supply voltage is non-linearly related to the percentage change in blade position, or gap, which it produces. Thus while the supply potentiometer 90 may be used to bring about the same percentage change, simultaneously, in all of the gaps, the slider 91 of the supply potentiometer must be calibrated in non-linear fashion. The nature of the calibration, for an assumed reference voltage of ten volts, is illustrated by way of example in FIG. 3, and the effect, upon the follow-up potentiometer 34, of setting assembly 21, of making the change under four separate conditions is illustrated in FIGS. 4–7 inclusive.

Turning first to the matter of calibration, our investigations show that the output voltage at the supply potentiometer 90 is equal to the selected reference voltage divided by a decimal factor corresponding to the desired percentage increase or decrease in gap width. For example, for a desired increase in gap width of fifty percent we use decimal factor 1.5, making the supply voltage, to be temporarily applied to all of the follow-up potentiometers, 6.67 v. This establishes point "a" on the calibration curve set forth in FIG. 3. Similarly where it is desired to produce a decrease of fifty percent in the percentage of all of the gaps, the decimal factor corresponding to minus fifty percent is 0.5. Thus the expression for the point of calibration becomes 10/0.5 or 20 volts as indicated at b, indicating that to secure a fifty percent reduction in gap in all sections the reference voltage in all of the follow-up potentiometers must be changed from the reference level to plus 20 volts. Other points on the curve may be similarly obtained. Note that each point on the calibration curve is dependent solely upon the assumed value of reference voltage and is not in any way dependent upon the pre-existing magnitude of the gap. The percentage gap arithmetic is arrived at automatically as the function of the follow-up potentiometers 34 in each of the setting assemblies.

Figure 3:
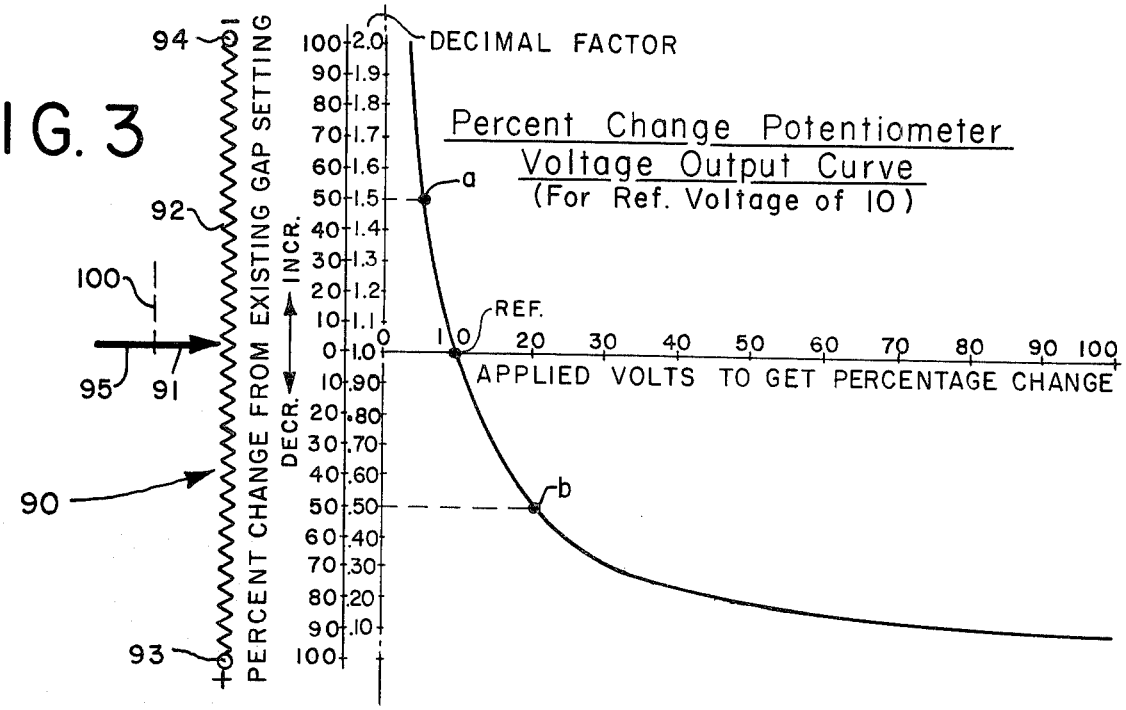
FIG. 3 shows a plot of output voltage of the voltage supply potentiometer in FIG. 2 and showing such potentiometer calibrated directly in terms of percentage increase and decrease of gap for an assumed reference potential of ten volts.

The existence of a non-linear supply potentiometer 90 has been assumed in FIG. 3. This has the advantage of providing a linear percentage calibration scale for maximum convenience in setting, but it will be understood that a multi-turn potentiometer of the linear type may be employed as the supply potentiometer provided it is accompanied by a conversion scale or non-linear readout corresponding to the calibration curve set forth.

With the components of the device understood, attention may be given to a typical operating sequence. Starting with the blade sections 11–16 in a normal condition of shut-off, the press operator can, by pressing the "increase" pushbuttons 35 in each of the setting assemblies, create gaps G in front of each blade section corresponding to the rate of ink feed required at that zone, or column position, which is a matter of trial and adjustment. If the page proof or printed result, usually as a result of changes in operating conditions, appears to be on the "thin" side, requiring, say, a fifty percent increase in the amount of ink without, however, changing the proportion of ink in adjacent column positions, the increase is initiated by pressing the "start" pushbutton 126, energizing the relay 120 and initiating the timed interval. This opens contact 122 of the relay, disabling the motor 101 so that it temporarily becomes ineffective to perform its reference-restoring function. Simultaneously, the normally closed isolating switches 53 in each of the setting assemblies are opened so that the voltage memory devices 50 store, in terms of voltage, the pre-existing gap settings of the associated potentiometer sliders 41. The percentage "increase" pushbutton 103 is next pressed energizing the motor 101, driving the slider 91 of the supply potentiometer to the plus fifty percent point, corresponding to point "a" on the calibration curve which produces a supply voltage 6.67 volts.

Figure 4:
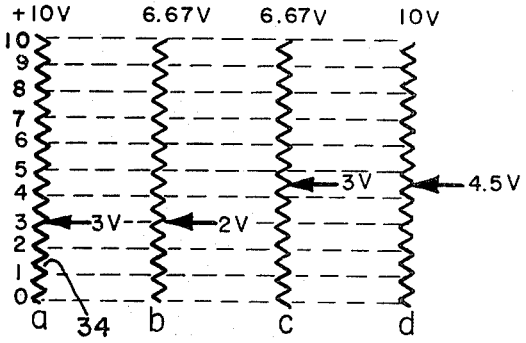
FIG. 4 shows, at a, b, c and d, the four conditions of the follow-up potentiometer in the making of a typical percentage increase in the gap at the first blade section.

The effect of this change in supply voltage is graphically illustrated in FIG. 4 which shows the follow-up potentiometer 34 coupled to blade section 11 in four successive conditions a–d. It will be assumed that in the initial condition a the slider on the follow-up potentiometer is at the three volt setting corresponding to the three unit gap of FIG. 1. Dropping the supply voltage to 6.67 volts as shown at b has the immediate effect of bringing about a corresponding proportionate change in the slider voltage, namely, from three volts to two volts without any change occurring in the slider position.

This results in two different voltages being simultaneously applied to the input terminals of the comparator 70: The voltage at input terminal 71 is at the "remembered" value of three volts, while the voltage at terminal 72 is now two volts. This produces a voltage differential of one volt which appears at output terminal 73 and which via a suitable power amplifier 74 produces rotation of the motor 31 which, acting through the mechanical connection 45, causes the potentiometer slider 41 to move correctively upscale until a slider voltage of three volts is achieved, as shown at c, which, applied to terminal 72, equals the three volts applied to terminal 71 reducing the differential to zero and turning off the motor 31.

Assuming that the timer 125 is now "timed out", relay 120 drops out, restoring all of the switches 53 to their closed conditions which precludes the development of any further output signal at the outputs of the comparators 70.

At the same time, reclosure of the contact 122 acts to restore the supply voltage to its reference condition. It does this by connecting the supply motor 101 again into the output circuit of the comparator 110 which now has two different voltages applied to its input, the master reference voltage of ten volts at input terminal 111 and the non-reference voltage of 6.67 which is applied to the input terminal 112. The resulting differential voltage of 3.33 volts applied via amplifier 114 to the motor 101 causes corrective movement of the slider 91 of the supply potentiometer until the slider voltage of ten volts is again achieved, reducing the differential to zero and turning off the motor with the slider in its reference position shown at d (FIG. 4). The effect of raising the voltage upon the follow-up potentiometer 34 to reference level is to proportionately raise the slider position voltage from three volts to 4.5 volts, which corresponds to an increase in the gap adjacent blade section 11 from 3 units to 4.5 units, so that the desired fifty percent increase has been carried out.

Figure 5:
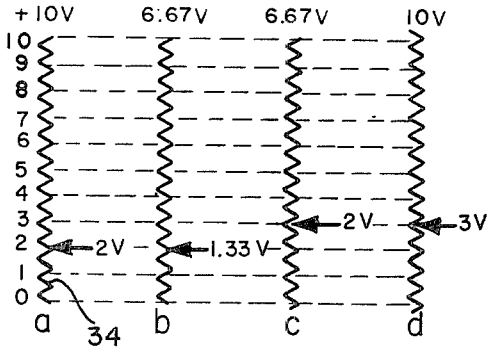
FIG. 5 shows, at a, b, c, and d, the four states of the follow-up potentiometer in making the same percentage increase in the gap at the second blade section.
Figure 6:
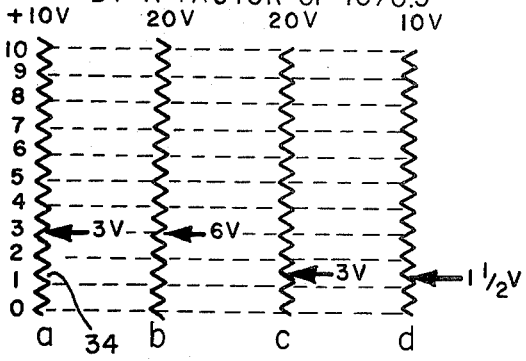
FIGS. 6 and 7 are diagrams corresponding to FIGS. 4 and 5, but for a percentage decrease rather than increase.
Figure 7:
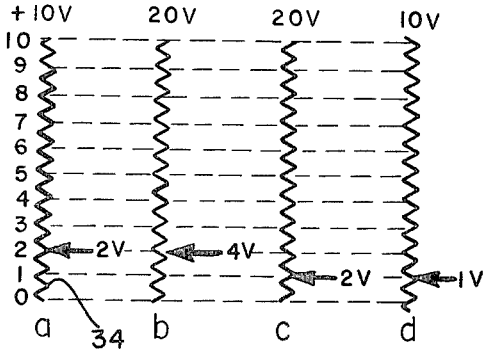

A fifty percent increase in gap, it will be noted, occurs regardless of the initial gap setting, as illustrated by the effect of the above procedure upon the second blade section 12 which has an initial gap of 2 units corresponding to a wiper position voltage of 2 volts shown at a in the diagram of FIG. 5. Thus "dialing in" a fifty percent increase in gap, dropping the 10 volt reference voltage to the 6.67 level, as at b, causes a drop in potentiometer position voltage in setting assembly 22 to 1.33 volts. The resulting differential voltage, 2 volts vs. 1.33 volts, applied to the comparator of assembly 22 causes the actuator 31 of the assembly to rotate in a direction to increase the gap in front of blade section 12 and incidentally moving the slider of the potentiometer to the 2 volt level (see c) wiping out the differential. Subsequent restoration of the 10 volt reference voltage upon timing out of the timer, and closure of relay contact 122, restores the slider position voltage to 3 volts (see d) corresponding to a three unit gap which is the desired increase of fifty percent over the originally existing two unit gap. The same percentage change occurs at the remaining blade sections 13, 14, 15 and 16.

The percentage control operates equally effectively in bringing about a simultaneous and equal percentage decrease in all of the initially existing gaps. The only difference is that the slider 91 of the potentiometer 90 in the supply device is rotated into the "fifty percent decrease" position corresponding to the position "b" on the calibration curve in FIG. 3. This results in the supply voltage being changed from the reference level of 10 to the level of 20 volts. Thus the slider position voltage of 3 volts, corresponding to an initial gap of 3 units, is changed to 6 volts (see FIG. **6-*b*) which is applied to the second input terminal of the comparator 70, resulting in a 3 volt differential across the comparator, correctively driving the motor 31 in a direction to reduce the slider position voltage to three volts as indicated at c, thereby reducing the voltage differential to zero and turning off the motor 31. Upon timing out of the timer 125, and closure of the switch 122, motor 101 in the supply device is reactivated, correctively restoring the slider 91 to the 10 volt reference position (see d). This reference voltage, being a sharp reduction from the temporary 20 volt level, results in a percentagewise reduction of the slider position voltage from 3 volts to $1\frac{1}{2}$ volts, corresponding to a new gap of $1\frac{1}{2}$ units which is, of course, the desired fifty percent decrease from the originally existing three unit gap defined by blade section 11. A similar gap reduction analysis can be carried out for the second blade section 12 on the basis of FIG. 7**.

Consequently, employing the present invention, two simple steps, namely, the triggering of the circuitry by pressing the start pushbutton 126 and the setting of the calibrated control of supply potentiometer 90, is effective to bring about promptly and simultaneously percentage changes in the same direction at each of the blade sections. Thus for a fifty percent increase in gap, the new, fifty percent increase setting is indicated by the full lines in FIG. **1*a***, compared to the original gaps indicated by the dotted lines, and with the units of gap set forth for each.

While the operation has been described in connection with a follow-up potentiometer 34 of the linear type, it is possible that for certain types of inks or under special conditions greater optimization may be provided by making the potentiometers depart slightly from linearity, for example, to subdue the percentage increase at the high end of the gap range. The term "linear" therefore is not to be strictly construed.

The invention has been described in connection with a sectional fountain blade simply for convenience and it will be understood that the invention is not limited to blade type metering but is aplicable, as well, to other equivalent types of metering on a zone or column basis; consequently, the term "blade section" shall be broadly interpreted to include equivalents. Moreover, while miniaturized electric motors are preferably employed as actuators, it is intended to cover any equivalent motion transducing device: for example, the directly controlled motors may be readily replaced by a constantly rotating source of motion having an interposed clutch for control purposes, without departing from the invention. Or, different types of motors may be used.

In the preferred embodiment the voltage memory or storing device 50 in each of the setting assemblies has an associated isolating switch 53 in series with the input. It will be apparent to one skilled in the art that the purpose of the switch is to isolate the memory device so that it stores and produces an output voltage which is the same as a last input voltage to which the device has been subjected; thus other specific isolation switch arrangements may be utilized, if desired, without departing from the invention as, for example, a switch which performs its isolating function by the shunting rather than the opening of circuit elements.

It is, moreover, one of the features of the invention that a single voltage supply potentiometer 90 suffices, through a supply terminal, or bus, 95, to provide the necessary voltage to all of the setting assemblies 21–26. However, it will be understood that, optionally, separate supply potentiometers 90, ganged if desired, may be used for the individual setting assemblies while still employing the teachings of the invention.

For a maximum of convenience the "start" pushbutton 126 may be ganged with both of the percentage change pushbuttons 102, 103 so that pressing either of the latter closes the "126" circuit to initiate the timer.

Simply by way of illustration and example the invention has been described herein in connection with use of voltage as a control signal, but it will be understood by one skilled in the art that current is equally applicable as a control medium and may indeed be more convenient where solid state devices are used as control elements; accordingly, the term "voltage" may be considered, for present purposes, broad enough to include the term "current" in defining the inventive contribution.

Turning, finally, to FIG. 2*a* there is shown the general type of a voltage storing (holding) circuit 50 which may be utilized in practicing the invention. The circuit is distinguished by an RC circuit which has a long discharging time constant when the isolating switch 53 is open including, for example, the capacitor 130 and associated resistors 131, 132. The illustrated circuit employs a transistor 133 which is especially selected and adjusted to have a low base current. The transistor is preferably connected in emitter follower configuration to preserve polarity. For more perfect voltage holding capability the transistor may be replaced, if desired, by a field effect transistor, or FET, a matter well within the skill of the art.

A simple form of voltage comparator 70, which is, in effect, a differential voltage amplifier, is illustrated in FIG. 2*b*. It utilizes a dual input operational amplifier 140 having input resistors 141, 142 and a feedback resistor 143. The intent and purpose of the comparator has been adequately explained earlier in the discussion and, based upon this, more sophisticated comparator circuitry may be employed which is, again, a matter well within the skill of the art.

The exemplary design of the present invention has been arbitrarily limited to percentage increments in gap of 100 percent and to percentage decrements of somewhat less than 100 percent due to the rapidly ascending voltage curve. It will be understood that where percentage increments or decrements are required outside of the range of the calibrated control 90, these can be obtained by successive cycling of the start pushbutton 126, allowing one percentage change to time out before initiating the second.

The circuit as shown in FIG. 2 has been presented in the form of a block diagram to facilitate understanding of the invention and not for the purpose of illustrating, rigorously, detailed circuit connections. For example, a simple form of motor of the reversible type, depending upon polarity, has been shown in positions 30, 101. For energizing these motors it will be assumed that the associated amplifier 74, 114 will be chosen so as to be capable of producing output voltages of a polarity corresponding to the algebraic value of the input voltage from the associated comparator.

What is claimed is:

1. In a metering system for metering the rate of ink flow to a printing plate on a column-by-column basis, the combination comprising an ink fountain including a fountain roller, a fountain blade made up of adjacent blade sections individually movable toward and away from the fountain roller to form a gap to adjust the ink film thickness, a miniature reversible electric motor having a step down drive connection drivingly coupled to each blade section, manual switches for initially energizing the motors to establish a respective clearance gap for each blade section to determine the initial ink feed rate to each column position, a linear follow-up potentiometer for each motor and having its slider mechanically coupled thereto, an adjustable voltage supply capable of establishing a reference voltage connection to all of the potentiometers and so that the resulting slider voltage of each potentiometer is a direct measure of the width of the associated initial gap, a voltage memory device for each potentiometer for responding to and storing the value of initial slider voltage, manual means for adjusting the voltage supply so that the voltage supplied to all of the follow-up potentiometers is changed in the same direction and amount to bring about change in the voltages on the various sliders to a new voltage related percentagewise to the initially existing voltage thereon, comparator means responsive to the difference between each initially existing voltage and the new voltage to produce a set of differential voltages, means for applying the differential voltages to the respective electric motors to move the associated sliders to new positions in which each differential voltage is reduced to zero by follow-up action so that all of the blade gaps simultaneously undergo a change to new gap widths related to the respective initial gap widths by the same fixed percentage and means for automatically restoring the voltage supply to the reference level.

2. In an ink metering system for metering ink to a printing plate on a column-by-column basis, the combination comprising an ink fountain including adjustable blade sections individually movable toward and away from the fountain roller to adjust the film thickness gap at respective column positions, a blade section setting assembly for each section comprising, in combination an actuator coupled to the blade section and having means for establishing a clearance gap providing an appropriate initial value of ink feed rate for the blade section, a linear follow-up potentiometer having its slider coupled to the blade section, an adjustable voltage supply for normally supplying to the potentiometer a reference voltage such that the slider voltage is a first voltage constituting a direct measure of the existing width of the gap, means for temporarily changing the voltage of the supply to a voltage which is equal to the reference voltage divided by a decimal multiplier corresponding to a desired percentage change in the width of gap resulting in a second slider voltage, comparator means responsive to the difference between the first and second slider voltages for energizing the actuator in a direction to cause the actuator to change the gap accompanied by a change in slider voltage until the second voltage is equal to the first voltage thereby to bring about the desired percentage change in the width of the gap at which time the actuator is deenergized, and means for thereafter restoring reference voltage to the potentiometer to place the same in condition for any subsequent percentage change.

3. In an ink metering system for metering ink to a printing plate in a printing press on a zonal column-by-column basis, the combination comprising flow control means including manually adjustable sections for providing an appropriate initial value of ink feed rate at the respective column positions, actuators coupled to the respective sections, a set of follow-up potentiometers having their sliders coupled to the respective sections, an adjustable voltage supply for normally supplying to the potentiometers a reference voltage such that each slider voltage is an initial voltage constituting a direct measure of the initial feed rates in the respective sections, means for temporarily changing the voltage of the supply to a non-reference voltage which is equal to the reference voltage divided by a decimal multiplier corresponding to a desired percentage change in the rates of flow resulting in a new slider voltage, means responsive to the difference between the initial and new slider voltages for energizing the respective actuators in a direction to cause the actuators to correctively adjust the sections accompanied by a change in slider position and voltage until difference is reduced to zero thereby to bring about the desired percentage change in the rates of flow at each section at which time the actuator is deenergized, and means for thereafter restoring reference voltage to the potentiometer to place the same in condition for any subsequent percentage change.

4. In a metering system for metering the rate of ink flow to a printing plate on a column-by-column basis, the combination comprising an ink fountain including a fountain roller, a fountain blade made up of adjacent blade sections individually movable toward and away from the fountain roller to form a gap to adjust the ink film thickness at respective column positions, a miniature power actuator connected to each blade section, individual adjusting means for initially energizing the actuators to establish a respective clearance gap for each blade section to determine the initial ink feed rate to each column position, a linear follow-up potentiometer for each actuator and having its slider mechanically coupled thereto, an adjustable voltage supply capable of establishing a reference voltage which is supplied to all of the potentiometers so that the resulting slider voltage of each potentiometer is a direct measure of the existing width of the respective initial gap, respective voltage comparators having first and second input terminals and an output terminal connected to each actuator for energizing the actuator, a voltage memory device interposed between the slider of the associated follow-up potentiometer and the first input terminal of the comparator, each memory device having an isolating switch effectively at the input thereof, the isolating switch being normally closed so that the memory device is exposed to a voltage corresponding to the initially existing gap, the second input terminal from the comparator being connected directly to the slider of the associated follow-up potentiometer, means for opening all of the isolating switches so that a persistant voltage corresponding to each existing gap is applied to the first input terminal of respective comparator, manual means for changing the voltage supply from its reference level so that the voltage supplied to all of the follow-up potentiometers is changed to bring about respective percentage changes in the voltages on the sliders and which are applied to the respective second input terminals, thereby to cause corresponding differential voltages to obtain at the outputs of the comparators causing the connected actuators and sliders to move to new equilibrium positions in which the differential voltages are each reduced to zero by follow-up action so that all of the blade gaps simultaneously undergo a change to new gaps related to the initial gaps by the same fixed percentage, means for reclosing the isolating switches to preclude further movement and for resetting the voltage memory devices, and means for automatically restoring the voltage supply to the reference level to place the follow-up potentiometers in condition for any subsequent percentage change.

5. The combination as claimed in claim 4 in which a timer is provided having a manually triggered input circuit for opening of the isolating switches and having an output circuit for reclosing the isolating switches after a predetermined time delay.

6. The combination as claimed in claim 4 in which interlock means are provided for insuring sequential (a) opening of the isolation switches and the changing of the voltage supply from reference level to bring about changes in the slider positions in the follow-up potentiometers and (b) the restoring of the voltage supply to reference level.

7. The combination as claimed in claim 4 in which the voltage supply has means including an interlock switch for maintaining the supply voltage at a reference level and in which means are provided for actuating the switch and thus disabling the positioning coincidentally with the actuation of the isolating switches.

8. In an ink metering system for metering ink to a printing plate on a column-by-column basis, the combination comprising an ink fountain including a fountain roller, a fountain blade made up of adjacent blade sections individually movable toward and away from the fountain roller to form a gap to adjust the film thickness, an adjustable voltage supply for normally producing a reference voltage, a blade setting assembly for each blade section comprising, in combination, an actuator mechanically connected to each blade section, initial adjusting means for individually energizing the actuators to establish a respective clearance gap for each blade section to determine an appropriate initial ink feed rate to each column position, a linear follow-up potentiometer having its slider connected to the associated blade section so that when reference voltage is applied the slider voltage is a direct measure of the existing width of gap, means for temporarily reducing the voltage of the supply thereby to change the slider voltage to a second, lower voltage, means responsive to the difference between the first and second slider voltages for energizing the actuator in a direction to increase the gap accompanied by an increase in slider voltage until the second voltage is equal to the first voltage thereby deenergizing the actuator, and means in the supply for restoring reference voltage to the follow-up potentiometer, the degree of temporary reduction in supply voltage being of such magnitude as to bring about a predetermined precentage increase in the width of gap.

9. In an ink metering system for metering the rate of ink flow to a printing plate on a column-by-column basis, the combination comprising an ink fountain including a fountain roller, a fountain blade made up of adjacent blade sections individually movable toward and away from a fountain roller to adjust the film clearance gap at respective column positions, a blade section setting assembly for each blade section which comprises, in combination, an actuator coupled to the blade section and having means for establishing a clearance gap providing an appropriate initial value of ink feed rate for the blade section, a linear follow-up potentiometer having its slider coupled to the blade section, an adjustable voltage supply for the potentiometer for normally applying to the potentiometer a reference voltage such that the slider position voltage is a direct measure of the existing width of the gap, means for temporarily increasing the voltage of the supply thereby to change the slider voltage to a second voltage which is higher than reference voltage, comparator means responsive to the difference between the first and second voltages for energizing the actuator in a direction to cause the actuator to decrease the gap accompanied by a decrease in slider position voltage until the second voltage equals the first voltage thereby to bring about a predetermined percentage decrease in the position of the slider and the gap of its blade section at which time the actuator is deenergized, and means for causing the supply thereafter to restore reference voltage to the potentiometer to place the latter in condition for any subsequent percentage change.

10. In an ink metering system for metering ink to a printing plate on a column-by-column basis, the combination comprising an ink fountain including a fountain roller, a fountain blade made up of adjacent blade sections individually movable toward and away from the fountain roller to adjust the film thickness fed at respective column positions, a blade section setting assembly for each blade section comprising, in combination, a power actuator coupled to the respective blade section, initial adjusting means for individually energizing the actuators to establish a respective clearance gap for each blade section to determine the ink feed to each column position, a follow-up potentiometer for each actuator and blade section and having its slider coupled to the blade section, voltage comparators each having first and second input terminals and an output terminal, a voltage memory device for each comparator including a normally closed isolation switch at its input, the first input terminal of each comparator being connected to the slider via a memory device, the second input terminal being connected directly to the slider, the output terminal of each comparator being coupled to the respective actuators, a voltage supply including a supply potentiometer for normally applying reference voltage to all of the follow-up potentiometers so that the voltages at the respective sliders are directly representative of the existing gaps at the associated blade sections and with the existing slider voltage being registered is the memory units via the normally closed switches for application to the first terminals of the comparators, means for opening the isolating switches, manual means operative when the isolating switches are opened for varying the supply potentiometer so that a second voltage is applied to the second input terminals of the comparators thereby producing an output voltage at the comparators which, applied to the actuators, causes each actuator to move the associated slider and blade section to a new gap position changed percentagewise from the original gap position, and means for thereafter automatically restoring the supply potentiometer to its reference voltage condition thereby restoring reference voltage to each of the follow-up potentiometers in readiness for any subsequent percentage change.

11. The combination as claimed in claim 10 together with means including a timer for maintaining the isolating switches open for a predetermined time interval adequate for the sliders to reach their new positions.

12. The combination as claimed in claim 11 in which a single timer is provided for simultaneous re-closing of all of the isolating switches.

13. The combination as claimed in claim 11 in which a switch is provided for automatically resetting the supply potentiometer to its reference condition, such switch being coupled for operation in unison with the isolating switches.

14. The combination as claimed in claim 1 or claim 2 or claim 3 or claim 4 or claim 8 or claim 9 in which the voltage supply includes a potentiometer for normally producing a reference voltage.

15. The combination as claimed in claim 1 or claim 2 or claim 3 or claim 4 or claim 8 or claim 9 in which the voltage supply includes a potentiometer and means including a motor connected to the slider for restoring the voltage to reference level.

16. The combination as claimed in claim 1 or claim 2 or claim 3 or claim 4 or claim 8 or claim 9 in which the restoring means includes a source of master reference voltage plus means including a motor responsive jointly to the source of master reference voltage and the output voltage of the supply for adjusting the supply to reference condition.

* * * * *